US010076918B2

(12) United States Patent
Murakami et al.

(10) Patent No.: US 10,076,918 B2
(45) Date of Patent: Sep. 18, 2018

(54) LIQUID-DISCHARGING HEAD, LIQUID-DISCHARGING UNIT, AND APPARATUS CONFIGURED TO DISCHARGE LIQUID

(71) Applicants: Tomoaki Murakami, Ibaraki (JP); Takahiro Yoshida, Ibaraki (JP); Masami Iwama, Ibaraki (JP); Takakazu Kihira, Ibaraki (JP)

(72) Inventors: Tomoaki Murakami, Ibaraki (JP); Takahiro Yoshida, Ibaraki (JP); Masami Iwama, Ibaraki (JP); Takakazu Kihira, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/439,327

(22) Filed: Feb. 22, 2017

(65) Prior Publication Data

US 2017/0253062 A1 Sep. 7, 2017

(30) Foreign Application Priority Data

Mar. 2, 2016 (JP) ..... 2016-039755
May 26, 2016 (JP) ..... 2016-105232
Jan. 6, 2017 (JP) ..... 2017-000990

(51) Int. Cl.
*B41J 29/377* (2006.01)

(52) U.S. Cl.
CPC ..... *B41J 29/377* (2013.01)

(58) Field of Classification Search
CPC .. B41J 2/14427; B41J 2/1648; B41J 2/04585; B41J 2/17513; B41J 2/14; B41J 2002/14346; B41J 2002/14419; B41J 2202/20; B41J 2/17553; B41J 2/04581; B41J 29/377

(Continued)

(56) References Cited

U.S. PATENT DOCUMENTS 7,311,372 B2 12/2007 Kubo
9,427,968 B2 8/2016 Kohda et al.

(Continued)

FOREIGN PATENT DOCUMENTS

JP 4186883 11/2008
JP 2013-166261 8/2013

*Primary Examiner* — Janelle M Lebron
(74) *Attorney, Agent, or Firm* — Cooper & Dunham LLP

(57) ABSTRACT

A liquid-discharging head includes a pressure-generating element configured to be actuated to apply pressure on liquid in a pressure chamber from which the liquid is discharged through a nozzle, an actuation controller configured to control actuation of the pressure-generating element, a heat-releasing member configured to contact the actuation controller, and a cover member configured to cover the actuation controller and part of the heat-releasing member. The heat-releasing member includes a first heat-releasing member and a second heat-releasing member. The first heat-releasing member is arranged outside the cover member and has a surface exposed to external air. The second heat-releasing member is arranged inside the cover member and has a first end portion to contact the actuation controller. The first heat-releasing member and the second heat-releasing member are arranged to contact each other.

14 Claims, 19 Drawing Sheets

(58) Field of Classification Search
USPC ..... 347/5, 9, 18, 20, 47, 54, 56, 61, 65, 85
See application file for complete search history.

(56) References Cited

U.S. PATENT DOCUMENTS

| | | | | |
|---|---|---|---|---|
| 9,452,633 | B2 | 9/2016 | Nemoto et al. | |
| 2007/0263036 | A1* | 11/2007 | Ito ..... | B41J 2/14209 347/54 |
| 2011/0096113 | A1 | 4/2011 | Yoshida | |
| 2015/0375504 | A1 | 12/2015 | Kitaoka et al. | |
| 2016/0185113 | A1 | 6/2016 | Yoshida et al. | |
| 2016/0236469 | A1 | 8/2016 | Iwama | |
| 2016/0297193 | A1 | 10/2016 | Yoshida | |

* cited by examiner

LIQUID-DISCHARGING HEAD, LIQUID-DISCHARGING UNIT, AND APPARATUS CONFIGURED TO DISCHARGE LIQUID

CROSS-REFERENCE TO RELATED APPLICATIONS

The present application claims the benefit of priority under 35 U.S.C. § 119 of Japanese Patent Application No. 2016-039755 filed on Mar. 2, 2016, Japanese Patent Application No. 2016-105232 filed on May 26, 2016, and Japanese Patent Application No. 2017-000990 filed on Jan. 6, 2017, the entire contents of which are incorporated herein by reference.

BACKGROUND OF THE INVENTION

1. Field of the Invention

The disclosures herein generally relate to a liquid-discharging head, a liquid-discharging unit, and an apparatus configured to discharge liquid.

2. Description of the Related Art

An apparatus (e.g., inkjet recording apparatus) including, for example, a liquid-discharging head or a liquid-discharging unit is known for an image-forming apparatus such as a printer, facsimile, copier, plotter, and multifunction peripheral including any combination of a printer, facsimile, copier, and plotter. In such an apparatus, the liquid is discharged by actuating the liquid-discharging head.

The liquid-discharging head includes nozzles that discharge liquid, individual liquid chambers that store the liquid in communication with the nozzles, a pressure generator (e.g., actuator or energy generator) that applies pressure on the liquid in the individual liquid chambers, and a common liquid chamber that stores the liquid to be supplied to the individual liquid chambers. By actuating the pressure generator, the pressure is applied on ink in the individual liquid chambers to discharge ink droplets from the nozzles and land the ink droplets on a recording medium.

The liquid-discharging heads (i.e., inkjet heads) for on-demand printing have become widely used. The liquid-discharging heads discharge minute liquid ink droplets, only when recording (i.e., printing) is necessitated. Regarding printing with inkjet heads, high-image quality outputs are demanded not only for consumer use but also for commercial use. Also in industrial fields of printing large-sized signboards or posters, there is a growing need for on-demand printing. Hence, inkjet recording apparatuses for the on-demand printing are increasingly used.

There have been demanded for downsizing and cost reduction of apparatuses in recent years. Regarding inkjet heads, there is a demand for downsizing of inkjet heads and increasing the number of nozzles, which is achieved by improving density of mounted nozzles enabled by reducing spacing between nozzles in line and enabled by reducing distances between a plurality of nozzle lines.

Japanese Patent No. 4186883, for example, proposes an inkjet recording apparatus having a simple configuration and a good assembly performance, and being capable of efficiently releasing heat generated by an actuator circuit. Japanese Patent No. 4186883 discloses a heat-releasing member including a first heat sink and a second heat sink that are arranged to form a substantially rectangular shape of hollow square interior. One ends of the first heat sink and the second heat sink are continuously coupled with each other, and the other ends of the first heat sink and the second heat sink interpose a heat generator of the actuator circuit.

SUMMARY OF THE INVENTION

In one embodiment, a liquid-discharging head includes a pressure-generating element configured to be actuated to apply pressure on liquid in a pressure chamber from which the liquid is discharged through a nozzle, an actuation controller configured to control actuation of the pressure-generating element, a heat-releasing member configured to contact the actuation controller, and a cover member configured to cover the actuation controller and part of the heat-releasing member. The heat-releasing member includes a first heat-releasing member and a second heat-releasing member. The first heat-releasing member is arranged outside the cover member and has a surface exposed to external air. The second heat-releasing member is arranged inside the cover member and has a first end portion to contact the actuation controller. The first heat-releasing member and the second heat-releasing member are arranged to contact each other.

DESCRIPTION OF THE PREFERRED EMBODIMENTS

In the following, a liquid-discharging head, a liquid-discharging unit, and an apparatus configured to discharge liquid in one or more embodiments will be described with reference to the accompanying drawings. The present disclosure is not limited to the embodiments to be described below. Other embodiments, additions, modifications, and omissions can be applied within the scope which a person skilled in the art could achieve. Any embodiments can be included in the present disclosure as long as the same effects and advantages are obtainable.

<Liquid-Discharging Head>

In one or more embodiments, the term "liquid-discharging head" refers to a component part that discharges and injects the liquid from nozzles. The liquid to be discharged is not particularly limited, but may have a viscosity or surface tension for which the liquid is dischargeable from the liquid-discharging head. The liquid to be discharged may have a viscosity equal to or lower than 30 mPa·s, at normal temperature and normal pressures or when the liquid is heated or cooled. More specifically, the discharged liquid may include, but are not limited to, for example, at least one of a solvent such as water or an organic solvent, a coloring agent such as a dye or pigment, a liquid solution, a suspending solution, and an emulsion. The liquid solution, the suspending solution, or the emulsion may contain at least one of a function-providing material such as a polymerizable compound, a resin, or a surface-active agent, a biomaterial such as DNA and amino acid, protein, or calcium, and an edible material such as a natural coloring matter. These examples of the liquid can be used for, for example, ink for inkjet, surface treatment liquid, liquid for forming component elements such as electronic elements or light-emitting elements or resist patterns of electronic circuits, and material liquid for three-dimensional shaping.

Examples of an energy generation source for discharging the liquid may include, but are not limited to, a piezoelectric actuator (e.g., stacked piezoelectric element and thin-film piezoelectric element), a thermal actuator using an electro-thermal conversion element such as a heating resistor, and a static actuator including a vibrating plate and a counter electrode.

Terms including image forming, recording, printing, photo printing, pressing, shaping, and molding described herein may all be synonyms.

First, a configuration of an inkjet head serving as a liquid-discharging head in a related art will be described with reference to FIG. 1A to FIG. 3.

Figure 1A:
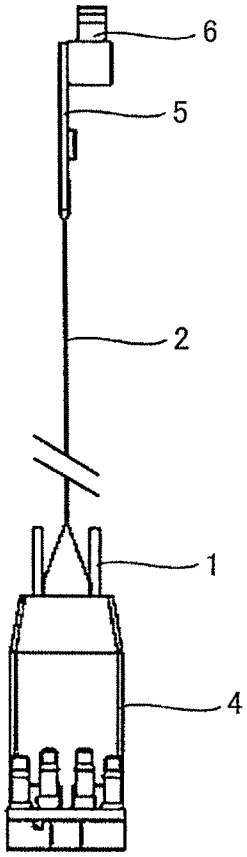
FIG.1A RELATED ART
FIG. 1A is a side view of an inkjet head in a related art.
Figure 1B:
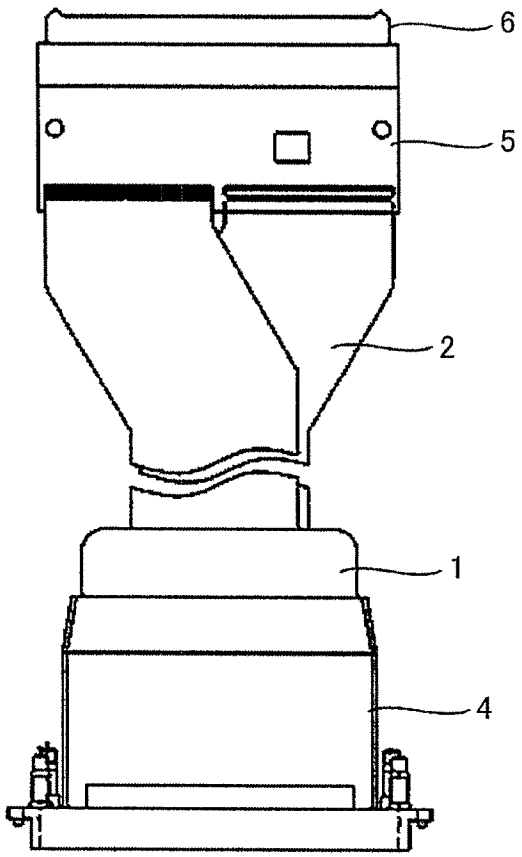
FIG.1B RELATED ART
FIG. 1B is a front view of the inkjet head in the related art.
Figure 1C:
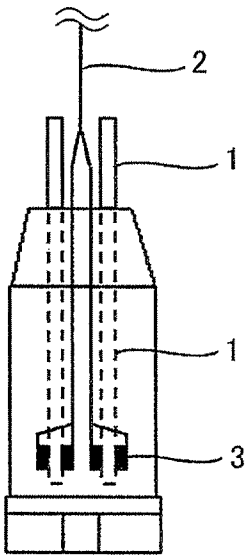
FIG.1C RELATED ART
FIG. 1C is a schematic view of an inner configuration in the inkjet head in the related art.

FIG. 1A is a side view of an inkjet head. FIG. 1B is a front view of the inkjet head. FIG. 1C is a view of an outline configuration of an inside of a body of the inkjet head. In the inkjet head illustrated in FIG. 1A to FIG. 1C, a head body and a cable portion (i.e., wiring member) have an integrated structure. A heat-releasing member 1 protrudes upward from the top of a cover member 4.

As illustrated in FIG. 1C, two heat-releasing members 1 are respectively joined with actuation controllers 3 at both surfaces.

The actuation controller 3 is coupled to a wiring member 2. The wiring member 2 extends from the head body and is coupled to a connector base 5 and a connector 6.

In comparison to the inkjet head illustrated in FIG. 1A to FIG. 1C, FIG. 2A to FIG. 2C and FIG. 3 illustrate an example in which the head body and the cable portion (i.e., wiring member) are separable from each other and the heat-releasing member is accommodated within the head body in order to achieve space saving.

Figure 2C:
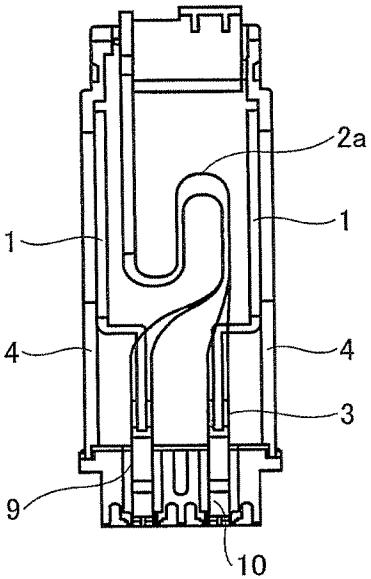
FIG.2C RELATED ART
FIG. 2C is a cross-sectional view of an outline configuration of an inside of the head body included in the inkjet head in the related art.
Figure 2B:
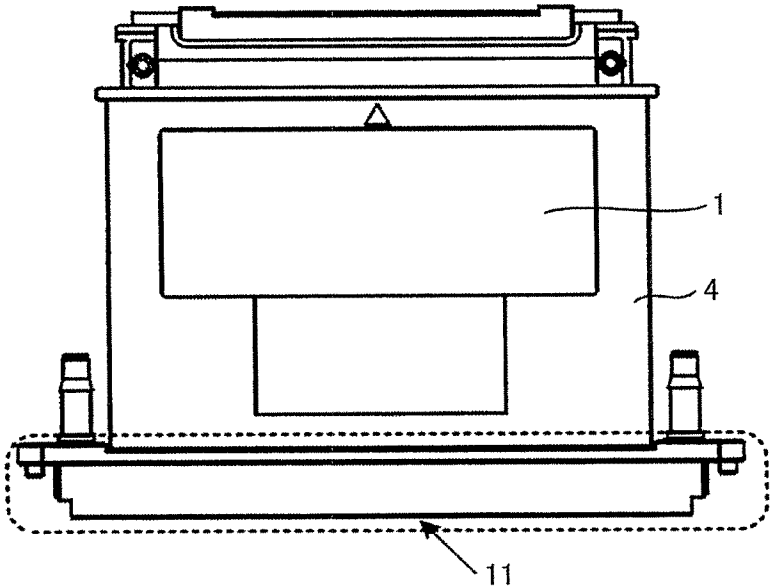
FIG.2B RELATED ART
FIG. 2B is a front view of the head body included in the inkjet head in the related art.
Figure 2A:
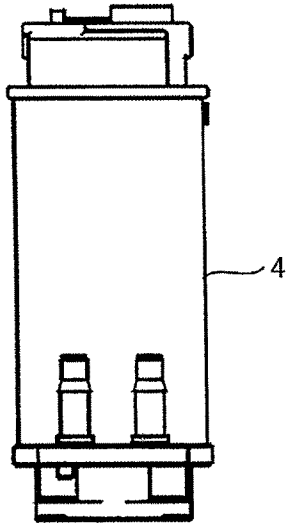
FIG.2A RELATED ART
FIG. 2A is a side view of a head body included in an inkjet head in a related art.
Figure 3:
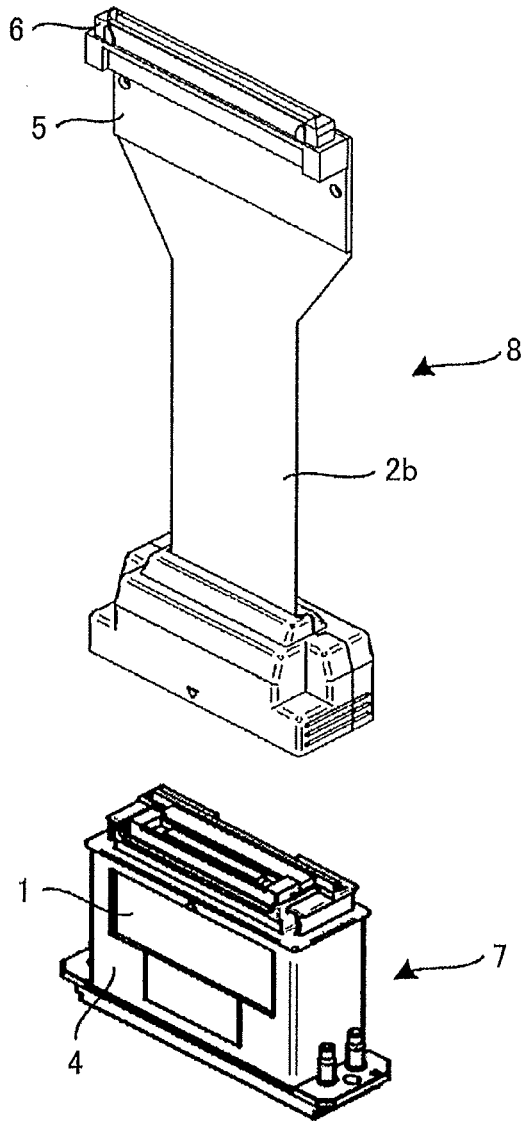
FIG.3 RELATED ART
FIG. 3 is a schematic view in which the head body and a cable portion are separate from each other.

FIG. 2A is a schematic side view of the separate head body. FIG. 2B is a schematic front view of the separate head body. FIG. 2C is a schematic cross-sectional view of an outline configuration of the inside of the separate head body. FIG. 3 is a schematic view in which a head body 7 and a cable portion 8 are separable from each other.

As illustrated in FIG. 3, since the head body 7 and the cable portion 8 are separate from each other, the space saving for the inkjet head is enabled. In a case where the head body 7 and the cable portion 8 are separate from each other, it may be difficult to couple the cable portion 8 to the head body 7 in the configuration where the heat-releasing member 1 protrudes upward from the top of the body of the inkjet head in the related art illustrated in FIG. 1A to FIG. 1C. Hence, the heat-releasing member 1 is accommodated within the cover member 4, as illustrated in FIG. 2C. In order to improve heat-releasing efficiency, a window portion is arranged on a front face of the cover member 4 to expose part of the heat-releasing member 1 to the outside from the window portion.

Figure 4:
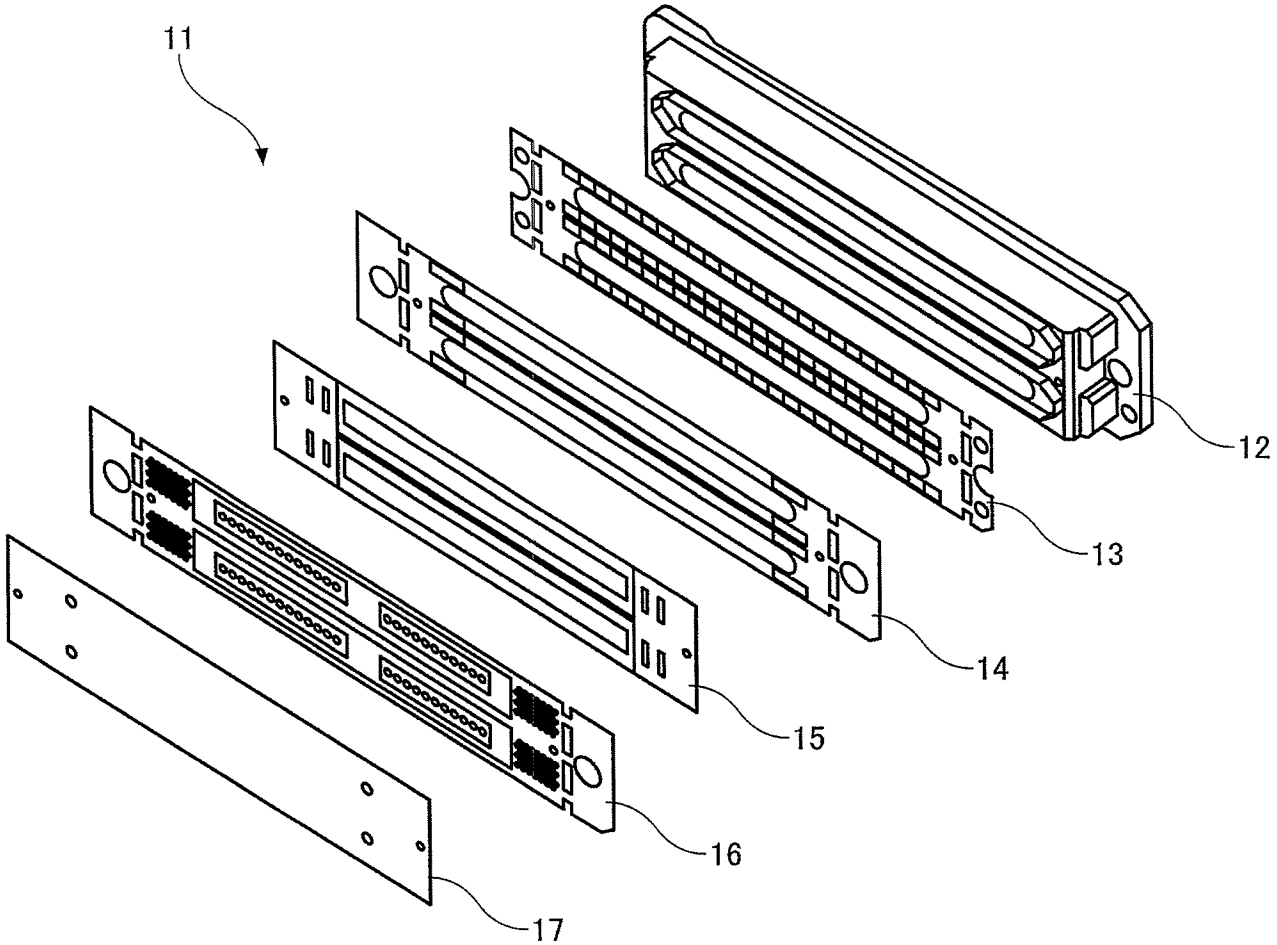
FIG. 4 is a schematic exploded view of a flow path unit and a housing included in a liquid chamber.

FIG. 4 illustrates a configuration of a liquid chamber 11 illustrated in FIG. 2B.

FIG. 4 is a schematic exploded view of a flow path unit and a housing included in a liquid chamber 11. The liquid chamber 11 includes a housing 12, a filter plate 13, a manifold 14, a vibrating plate 15, a restrictor plate 16, and an orifice plate 17.

The vibrating plate 15 is joined with a pressure-generating element 10. A voltage applied to the pressure-generating element 10 joined with a SUS base 9 deflects the pressure-generating element 10. This deflection compresses individual liquid chambers included in the restrictor plate 16 through the vibrating plate 15, and discharges the ink from nozzle holes on the orifice plate 17. This process generates heat in the actuation controller 3. The generated heat is released to the outside by the heat-releasing member 1 joined with the actuation controller 3.

The amount of heat released by the heat-releasing member 1, however, is insufficient in the configuration illustrated in FIG. 2A to FIG. 2C and FIG. 3. As a result, the maximum actuation frequency or the maximum discharged amount may be limited. In contrast, according to the liquid-discharging head in one or more embodiments to be described below, space saving and good heat-releasing efficiency are both enabled and an increase in maximum discharged quantity is enabled.

In a liquid-discharging head in one or more embodiments, a pressure-generating element 10 is actuated to apply pressure on liquid in a liquid chamber to discharge the liquid from a nozzle, the liquid-discharging head includes an actuation controller 3 configured to control actuation of the pressure-generating element 10, a heat-releasing member 1 configured to contact the actuation controller 3, and a cover member 4 configured to cover the actuation controller 3 and part of the heat-releasing member 1. The heat-releasing member 1 is arranged on the outside of the cover member. The heat-releasing member 1 includes a first heat-releasing member 1*a* and a second heat-releasing member 1*b*. The first heat-releasing member 1*a* has a surface exposed to external air, and the second heat-releasing member is arranged on the inside of the cover member and has a first end portion for abutting the actuation controller 3. The first heat-releasing member 1*a* and the second heat-releasing member 1*b* are configured to contact each other.

Specifically, the liquid-discharging head includes a liquid chamber 11, an upper device signaling wiring member 2*b*, a relay wiring member 2*a*, the actuation controller 3, the cover member 4, and the heat-releasing member 1. The liquid chamber 11 includes a flow path unit formed by stacking members functioning as nozzles, a pressure chamber, and a restrictor, the pressure-generating element 10 joined with the flow path unit and configured to generate the pressure to discharge the liquid, and the housing 12 that accommodates the pressure-generating element 10 and that is stacked on the flow path unit. The upper device signaling wiring member 2*b* is foldable and transfers electrical signals from an upper device. The relay wiring member 2*a* is coupled to the upper device signaling wiring member 2*b* and the pressure-generating element 10. The actuation controller 3 is mounted on the relay wiring member 2*a* and controls the actuation of the pressure-generating element 10 in accordance with the electrical signals supplied from the upper device. The cover member 4 accommodates the relay wiring member 2*a* and the actuation controller 3 to protect the relay wiring member 2*a* and the actuation controller 3. The heat-releasing member (i.e., heat sink) 1 releases the heat generated in the actuation controller 3 to the outside of the head body 7.

First Embodiment

A first embodiment will be described with reference to FIG. 5A to FIG. 6C.

In the liquid-discharging head in the present embodiment, the wiring member 2 that transfers the electrical signals to the actuation controller 3 is separable from the head body 7 including the heat-releasing member 1. Specifically, the cable portion 8 including the upper device signaling wiring member 2*b* is separable from the head body 7 including the liquid chamber 11, the cover member 4, and the heat-releasing member 1.

Figure 5C:
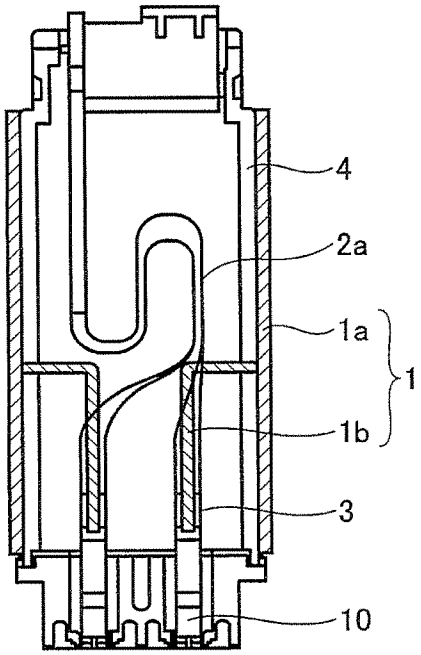
FIG. 5C is a cross-sectional view of an outline configuration of the inside of the head body included in the liquid-discharging head in the first embodiment.
Figure 5B:
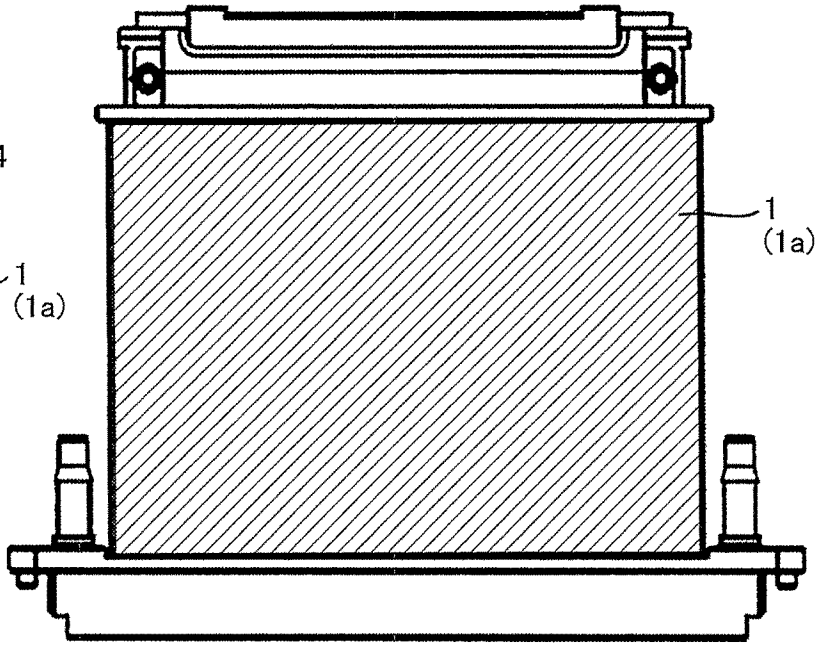
FIG. 5B is a front view of the head body included in the liquid-discharging head in the first embodiment.
Figure 5A:
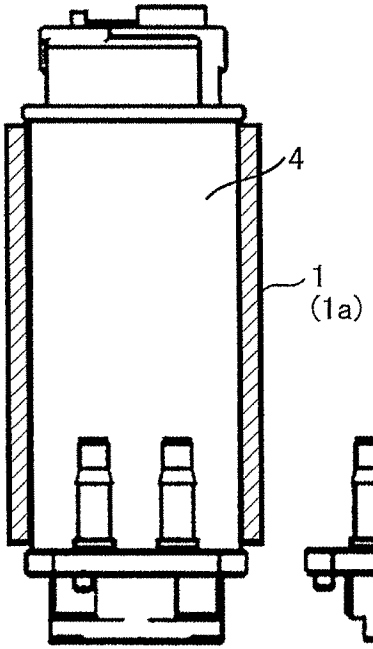
FIG. 5A is a side view of a head body included in a liquid-discharging head in a first embodiment.
Figure 6A:
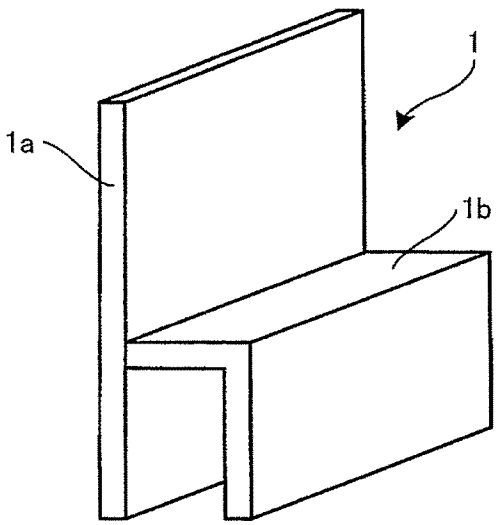
FIG. 6A to FIG. 6C are views of one example of a configuration of a heat-releasing member of FIG. 5A to FIG. 5C.

FIG. 5A is a schematic side view of the head body 7 included in the liquid-discharging head in the present embodiment. FIG. 5B is a schematic front view of the head body 7 included in the liquid-discharging head in the present embodiment. FIG. 5C is a cross-sectional view of an outline configuration of the inside of the liquid-discharging head in the present embodiment. FIG. 6A to FIG. 60 are views of a configuration of the heat-releasing member 1 in the present embodiment.

As illustrated in FIG. 5A to FIG. 5C, the heat-releasing member 1 includes the first heat-releasing member 1*a* and the second heat-releasing member 1*b*. The first heat-releasing member 1*a* is arranged on the outside of the cover member 4 and includes a surface exposed to the external air. The second heat-releasing member 1*b* arranged on the inside of the cover member 4 and includes one end portion for abutting the actuation controller 3. The first heat-releasing member 1*a* and the second heat-releasing member 1*b* are configured to contact each other.

In such a configuration, only one of the faces of the first heat-releasing member 1*a* is exposed to the outside, and another one of the faces of the first heat-releasing member 1*a* is configured to contact the second heat-releasing member 1*b* and is not exposed to the outside. This configuration prevents appearance degradation caused by pressed-out adhesive, for example.

Note that the heat-releasing members 1 are respectively arranged on both faces of the cover member 4 opposite to each other, as illustrated in FIG. 5A and FIG. 5C.

Figure 6B:
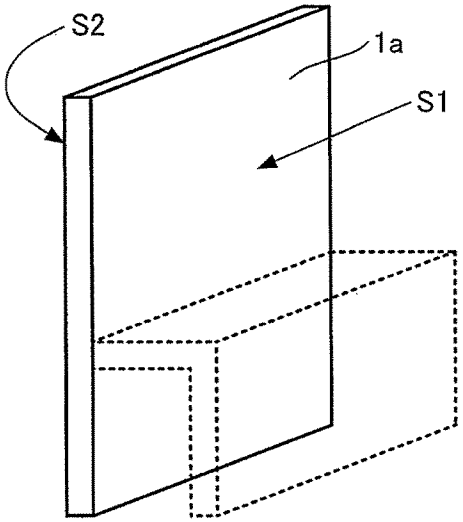
Figure 6C:
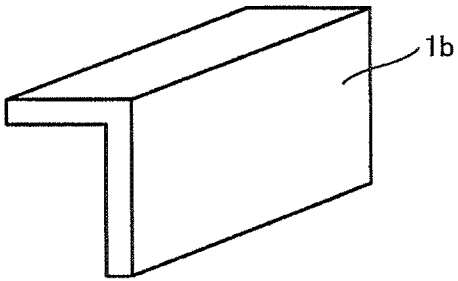

Referring to FIG. 6B, the first heat-releasing member 1*a* included in the heat-releasing member 1 will be described.

A surface S1 of the first heat-releasing member 1*a* is joined with the cover member 4 of the head body. A surface S2 is exposed to the external air. The first heat-releasing member 1*a* is arranged to cover a side surface in a longer direction of the cover member 4. Sealing performance of the first heat-releasing member 1*a* is improved by enlarging the joining area between the surface S1 and the cover member 4. Note that at least a half of the area of the side surface in the longer direction of the cover member 4 may be covered with the first heat-releasing member 1*a* in one embodiment. All of the area of the side surface in the longer direction of the cover member 4 may be covered with the first heat-releasing member 1*a* in another embodiment.

Since one of the end portions of the second heat-releasing member 1*b* abuts the actuation controller 3, heat generated in the actuation controller 3 transfers through the second heat-releasing member 1*b* and reaches the first heat-releasing member 1*a* having the surface S2 exposed to the external air. Thus, the heat is released in a sufficient manner.

Second Embodiment

A second embodiment will be described with reference to FIG. 7 and FIG. 8A to FIG. 8C.

In the liquid-discharging head in the present embodiment, the cable portion 8 that transfers the electrical signals to the actuation controller 3 is separable from the head body 7 including the heat-releasing member 1. Specifically, the cable portion 8 including an upper device signaling wiring member 2*b* is separable from the head body 7 including the liquid chamber 11, the cover member 4, and the heat-releasing member 1.

Figure 7:
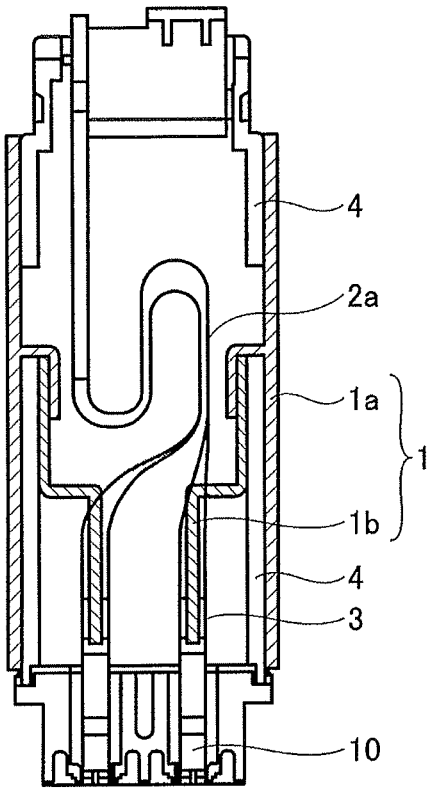
FIG. 7 is a cross-sectional view of an outline configuration of the inside of the head body included in the liquid-discharging head in a second embodiment.
Figure 8A:
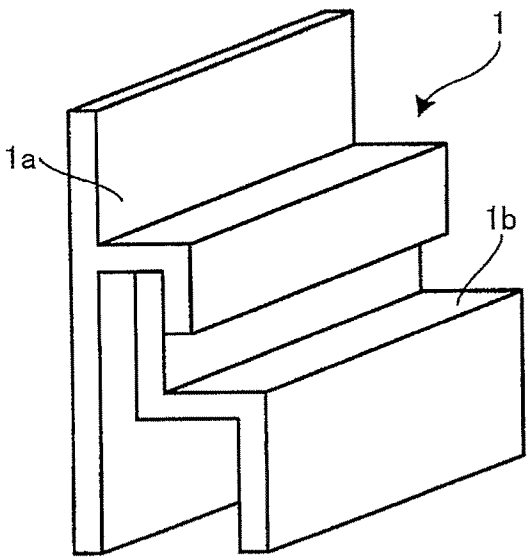
FIG. 8A to FIG. 8C are views of one example of a configuration of the heat-releasing member of FIG. 7.
Figure 8B:
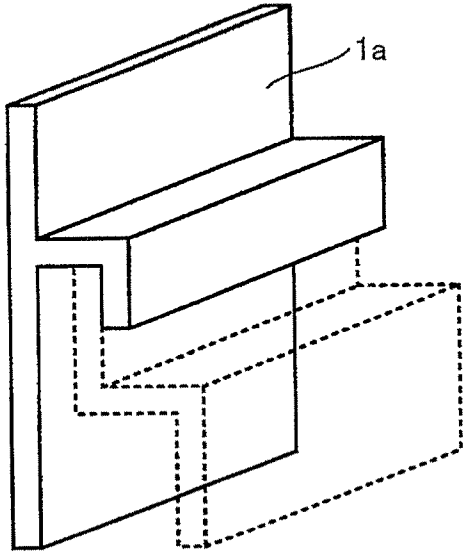
Figure 8C:
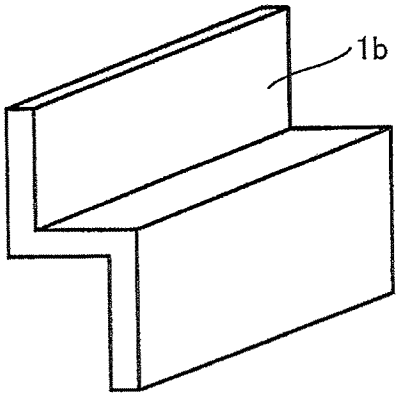

FIG. 7 is a cross-sectional view of an outline configuration of the inside of the head body 7 included in the liquid-discharging head in the present embodiment. FIG. 8A to FIG. 8C are views of a configuration of the heat-releasing member 1 in the present embodiment.

As illustrated in FIG. 7 and FIG. 8A to FIG. 8C, the heat-releasing member 1, in the present embodiment includes the first heat-releasing member 1*a* and the second heat-releasing member 1*b*. The first heat-releasing member 1*a* is arranged on the outside of the cover member 4 and includes the surface S2 exposed to the external air. The second heat-releasing member 1*b* is arranged on the inside of the cover member 4, and includes one end portion for abutting the actuation controller 3. The first heat-releasing member 1*a* includes an engaging portion having a letter L-shaped cross section. The engaging portion of the first heat-releasing member 1*a* abuts an engaging portion of the second heat-releasing member 1*b*.

The engaging portion of the first heat-releasing member 1*a* protrudes from a plate-shaped portion of the first heat-releasing member 1*a*. The engaging portion of the first heat-releasing member 1*a* abuts the engaging portion of the second heat-releasing member 1*b*. One of the surfaces of the plate-shaped portion is configured to contact an external surface of the cover member 4, and another surface of the plate-shaped portion is exposed to the external air. In a similar manner to the first embodiment, the first heat-releasing member 1*a* is arranged to cover the side surface in the longer direction of the cover member 4.

The second heat-releasing member 1*b* has a step-shaped structure. One of the end portions of the second heat-releasing member 1*b* abuts the actuation controller 3, and another one of the end portions of the second heat-releasing member 1*b* abuts an internal surface of the cover member 4. Since one of the end portions of the second heat-releasing member 1*b* abuts the actuation controller 3, the heat generated in the actuation controller 3 transfers through the second heat-releasing member 1*b* and reaches the first heat-releasing member 1*a* having the surface S2 exposed to the external air. Thus, the heat is released in a sufficient manner.

Figure 9:
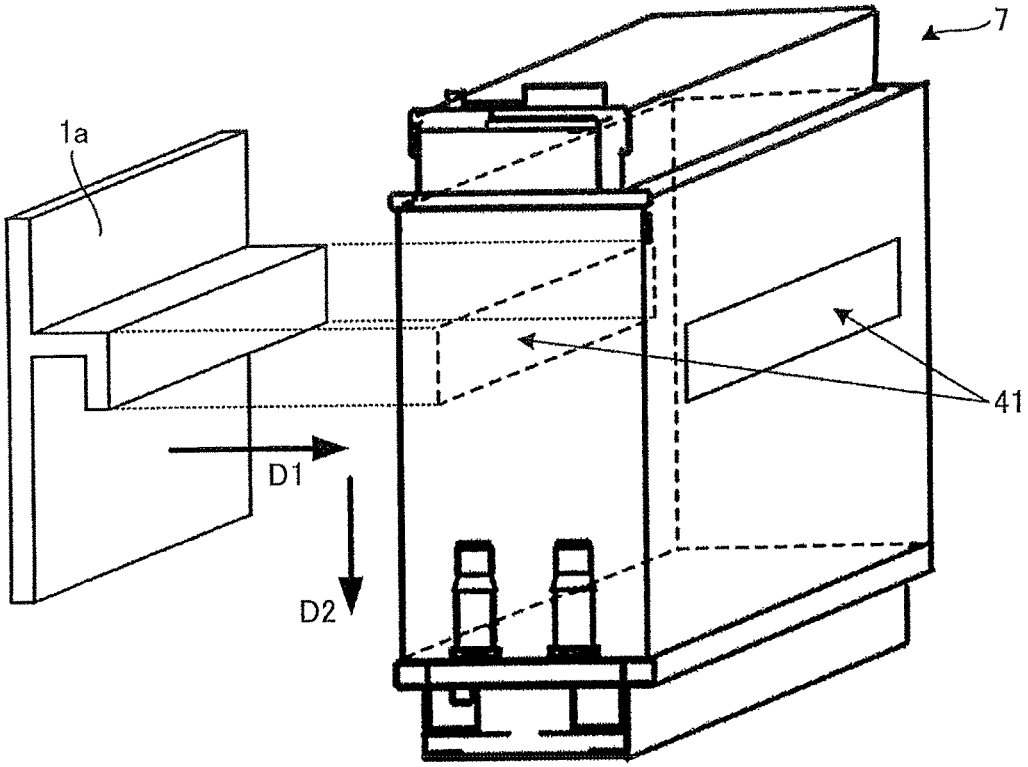
FIG. 9 illustrates one example of a method of attaching the heat-releasing member.

FIG. 9 illustrates a method for attaching the first heat-releasing member 1*a* to the head body 7 included in the liquid-discharging head in the present embodiment. Opening portions 41 are defined at the cover member 4 of the head body 7, so that the engaging portions of the first heat-releasing member 1*a* can be respectively inserted into the opening portions 41. By inserting the first heat-releasing member 1*a* in a direction D1 and subsequently pushing the first heat-releasing member 1*a* in a direction D2, the engaging portion of the first heat-releasing member 1*a* abuts the engaging portion of the second heat-releasing member 1*b* that has been previously arranged. Therefore, the first heat-releasing member 1*a* and the second heat-releasing member 1*b* are coupled with each other, as illustrated in FIG. 7.

As described above, in the present embodiment, a good assembly performance is enabled. In other words, the head body 7 is assembled easily. Hence, an attaching performance is also improved. Only one of the surfaces of the first heat-releasing member 1*a* is exposed to the outside, and another surface of the first heat-releasing member 1*a* is configured to contact the first heat-releasing member 1*a* and is not exposed to the outside. This configuration prevents appearance degradation caused by pressed-out adhesive, for example.

In contrast to the above configuration, by providing the engaging portion having a letter L shape for the second heat-releasing member 1*b*, one end portion of the first heat-releasing member 1*a* may be fit with the engaging portion of the second heat-releasing member 1*b*. Alternatively, by providing engaging portions each having a letter L shape at end portions for both the first heat-releasing member 1*a* and the second heat-releasing member 1*b*, the engaging portions may be assembled to contact each other.

In other words, at least one of the first heat-releasing member 1*a* and the second heat-releasing member 1*b* may include the engaging portion having a letter L-shaped cross section, so that the first heat-releasing member 1*a* and the second heat-releasing member 1*b* may abut each other via the engaging portions.

Third Embodiment

A third embodiment will be described with reference to FIG. 10 and FIG. 11A to FIG. 11C.

Regarding the liquid-discharging head in the present embodiment, the cable portion 8 including the upper device signaling wiring member 2*b* is separable from the head body 7 including the liquid chamber 11, the cover member 4, and the heat-releasing member 1.

Figure 10:
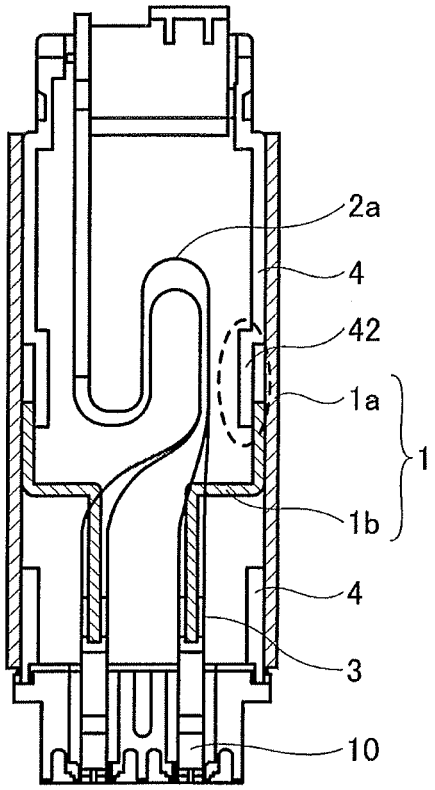
FIG. 10 is a cross-sectional view of an outline configuration of the inside of the head body included in the liquid-discharging head in a third embodiment.
Figure 11A:
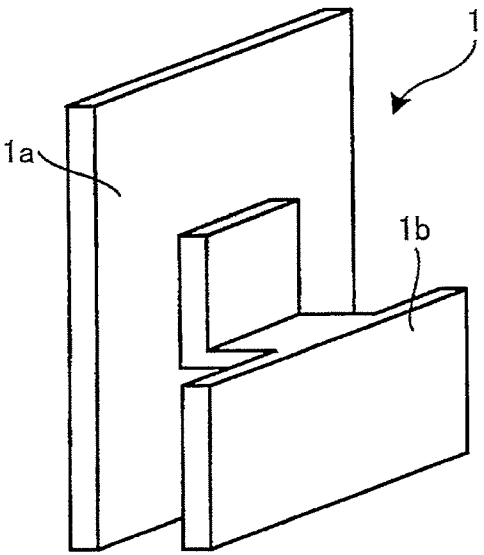
FIG. 11A to FIG. 11C are views of one example of a configuration of the heat-releasing member of FIG. 10.
Figure 11B:
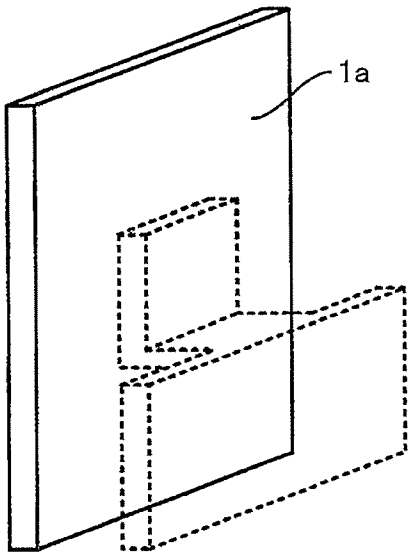
Figure 11C:
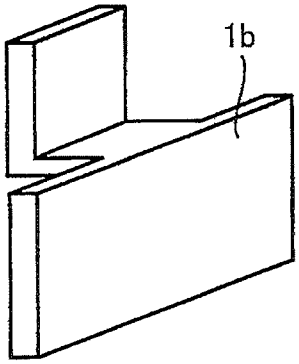

FIG. 10 is a cross-sectional view of an outline configuration of the inside of the head body 7 included in the liquid-discharging head in the present embodiment. FIG. 11A to FIG. 11C are views of a configuration of the heat-releasing member 1 in the present embodiment.

As illustrated in FIG. 10, the heat-releasing member 1 includes the first heat-releasing member 1*a* and the second heat-releasing member 1*b*. The first heat-releasing member 1*a* is arranged on the outside of the cover member 4 and includes the surface S2 exposed to the external air. The second heat-releasing member 1*b* is arranged on the inside of the cover member 4 and includes one end portion for abutting the actuation controller 3. In the present embodiment, the cover member 4 includes a bending portion 42 capable of abutting another end portion of the second heat-releasing member 1*b*. The bending portion 42 and the first heat-releasing member 1*a* sandwich another end portion of the second heat-releasing member 1*b*, between the bending portion 42 and the first heat-releasing member 1*a*.

The first heat-releasing member 1*a* includes the plate-shaped portion, and is arranged to cover a side surface in the longer direction of the cover member 4, in a similar manner to the first embodiment.

In such a configuration, the head body 7 is assembled easily, and the attaching performance is improved. Additionally, only one of the surfaces of the first heat-releasing member 1*a* is exposed to the outside, and another surface of the first heat-releasing member 1*a* is configured to contact the second heat-releasing member 1*b* and is not exposed to the outside. This configuration prevents appearance degradation caused by pressed-out adhesive, for example.

The second heat-releasing member 1*b* has a step-shaped structure in which the faces in the step-shaped structure have different widths in the longer direction of the cover member 4. One of the end portions of the second heat-releasing member 1*b* abuts the actuation controller 3, and another end portion of the second heat-releasing member 1*a* abuts the bending portion 42 of the cover member 4 and the first heat-releasing member 1*a*. Since one of the end portions of the second heat-releasing member 1*b* abuts the actuation controller 3, the heat generated in the actuation controller 3 transfers through the second heat-releasing member 1*b* and reaches the first heat-releasing member 1*a* having the surface S2 exposed to the external air. Thus, the heat is released in a sufficient manner.

Forth Embodiment

A fourth embodiment will be described with reference to FIG. 12A to FIG. 12C and FIG. 13A to FIG. 13C.

Figure 12C:
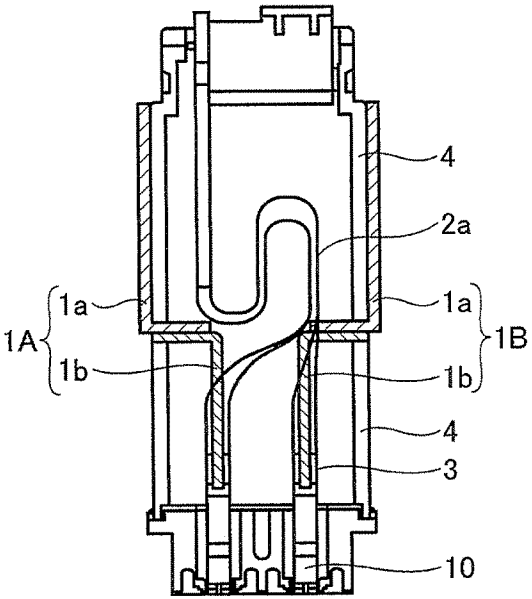
FIG. 12C is a cross-sectional view of an outline configuration of the inside of the head body included in the liquid-discharging head in the fourth embodiment.
Figure 12B:
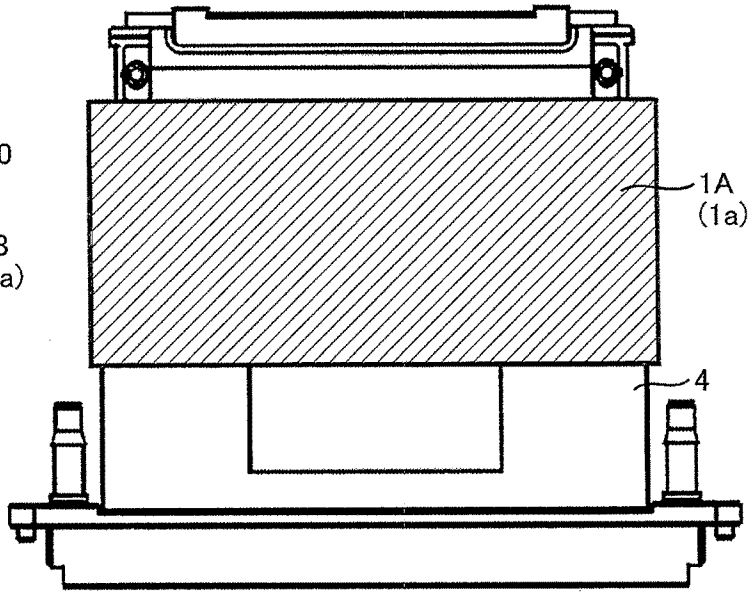
FIG. 12B is a front view of the head body included in the liquid-discharging head in the fourth embodiment.
Figure 12A:
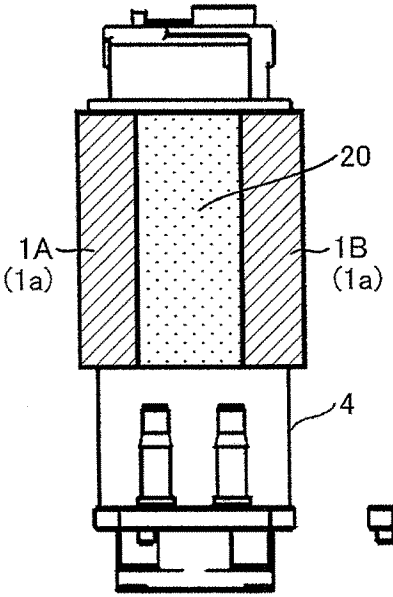
FIG. 12A is a side view of the head body included in a liquid-discharging head in a fourth embodiment.

In the liquid-discharging head in the present embodiment, the cable portion 8 including the upper device signaling wiring member 2*b* is separable from the head body 7 including the liquid chamber 11, the cover member 4, and the heat-releasing member 1. FIG. 12A is a schematic side view (in a shorter direction) of the head body 7 included in the liquid-discharging head in the present embodiment. FIG. 12B is a schematic front view (in a longer direction) of the head body 7 included in the liquid-discharging head in the present embodiment. FIG. 12C is a cross-sectional view of an outline configuration of the inside of the head body 7 included in the liquid-discharging head in the present embodiment.

Figure 13A:
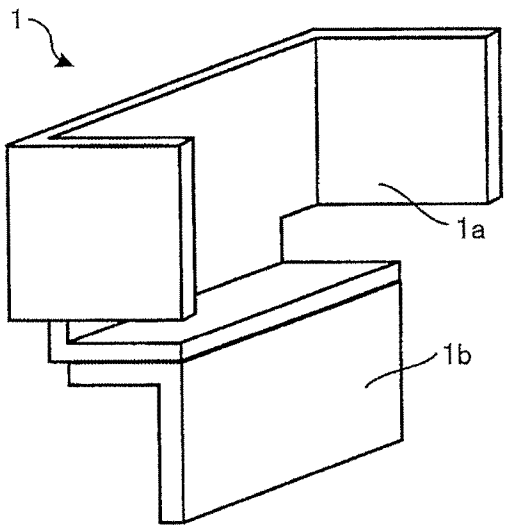
FIG. 13A to FIG. 13C are views of one example of a configuration of the heat-releasing member of FIG. 12A to FIG. 12C.
Figure 13B:
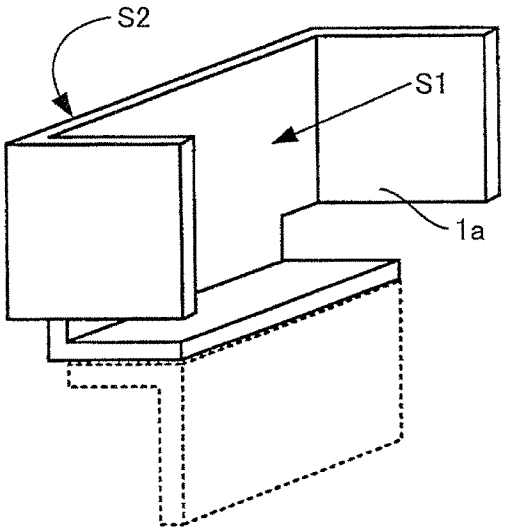
Figure 13C:
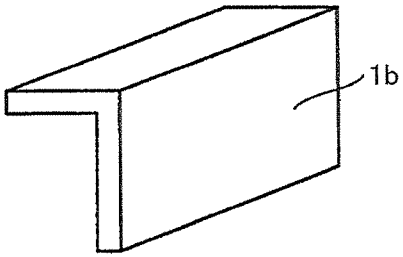

FIG. 13A to FIG. 13C are views of a configuration of the heat-releasing member 1 in the present embodiment.

In the present embodiment, the heat-releasing member 1 includes the first heat-releasing member 1*a* and the second heat-releasing member 1*b*. The first heat-releasing member 1*a* is arranged on the outside of the cover member 4 and includes the surface S2 exposed to the external air. The second heat-releasing member 1*b* is arranged on the inside of the cover member 4 and includes one end portion for abutting the actuation controller 3. Two pairs of heat-releasing members 1 (1A and 1B) are thermally coupled to each other. Each of the two pairs of heat-releasing members 1 includes the first heat-releasing member 1*a* and the second heat-releasing member 1*b*, which are configured to contact each other.

As illustrated in FIG. 13B, the surface S1 of the first heat-releasing member 1*a* abuts the cover member 4 of the head body. The surface S2 is exposed to the external air. As illustrated in FIG. 12A, the first heat-releasing member 1*a* has a shape configured to cover part of the side surface in the longer direction of the cover member 4 and part of the side surface in the shorter direction of the cover member 4. The enlarged joining area between the surface S1 and the cover member 4 further improves the sealing performance. In addition, the first heat-releasing members 1*a* of the two pairs of the heat-releasing members 1A and 1B may be configured to directly contact each other. As illustrated in FIG. 12A, however, a coupling member 20 may couple the heat-releasing members 1A and 1B on a side surface in the shorter direction of the cover member 4, in one embodiment. The coupling member 20 may include a securing material (e.g., adhesive tape) having a thermal conductivity, for example.

As illustrated in FIG. 12C and FIG. 13A, with the first heat-releasing member 1*a* contacting the second heat-releasing member 1*b*, by bringing the first heat-releasing member 1*a* of the heat-releasing member 1A and the first heat-releasing member 1*a* of the heat-releasing member 1B into contact with each other, the two pairs of the heat-releasing members 1A and 1B are thermally coupled to each other. Since one of the end portions of the second heat-releasing member 1*b* abuts the actuation controller 3, the heat generated in the actuation controller 3 transfers through the second heat-releasing member 1*b* and reaches the first heat-releasing member 1*a* of one of the heat-releasing members 1A and 1B. Further, the heat transfers to the first heat-releasing member 1*a* of the other one of the heat-releasing members 1A and 1B.

As described above, in such a configuration where the two pairs of the heat-releasing members 1A and 1B are thermally coupled to each other in the present embodiment, all of the actuation controllers 3 (i.e., four actuation controllers in the present embodiment) can have uniform temperatures.

Fifth Embodiment

A fifth embodiment will be described with reference to FIG. 14A to FIG. 14C and FIG. 15A to FIG. 15C.

In the liquid-discharging head in the present embodiment, the cable portion 8 including the upper device signaling wiring member 2*b* is separable from the head body 7 including the liquid chamber 11, the cover member 4, and the heat-releasing member 1.

Figure 14C:
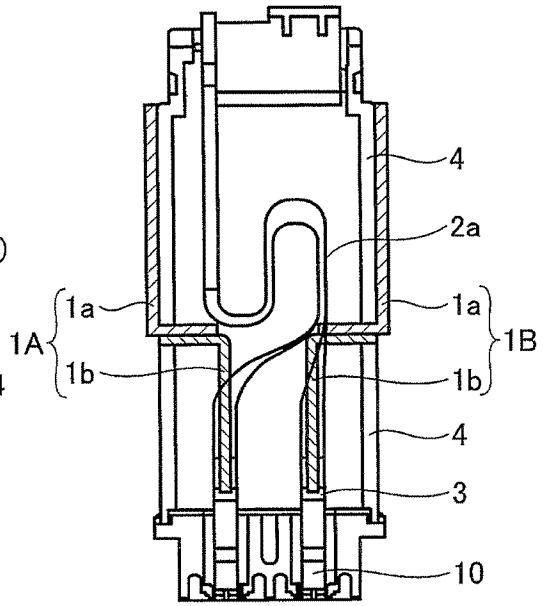
FIG. 14C is a cross-sectional view of an outline configuration of the inside of the head body included in the liquid-discharging head in the fifth embodiment.
Figure 14B:
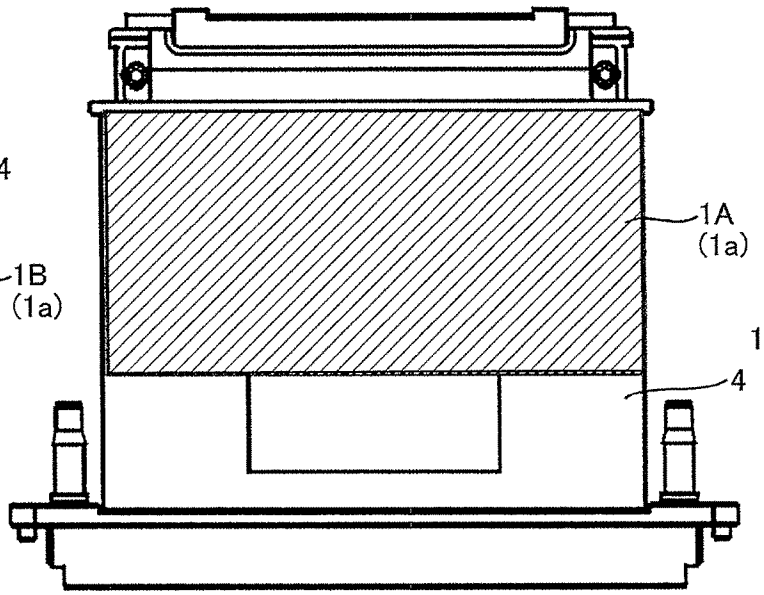
FIG. 14B is a front view of the head body included in the liquid-discharging head in the fifth embodiment.
Figure 14A:
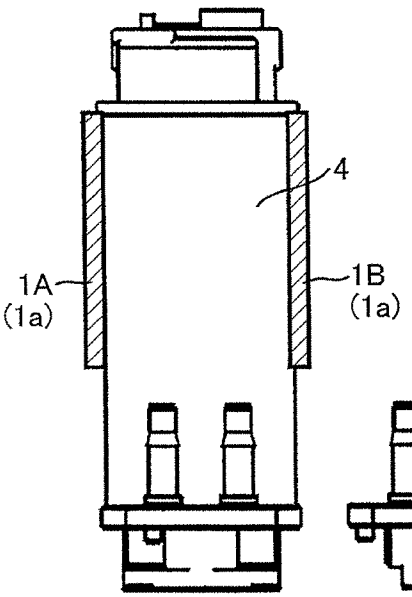
FIG. 14A is a side view of the head body included in a liquid-discharging head in a fifth embodiment.

FIG. 14A is a schematic side view (in the shorter direction) of the head body 7 included in the liquid-discharging head in the present embodiment. FIG. 14B is a schematic front view (in the longer direction) of the head body 7 included in the liquid-discharging head in the present embodiment. FIG. 14C is a cross-sectional view of an outline configuration of the inside of the head body 7 included in the liquid-discharging head in the present embodiment.

Figure 15A:
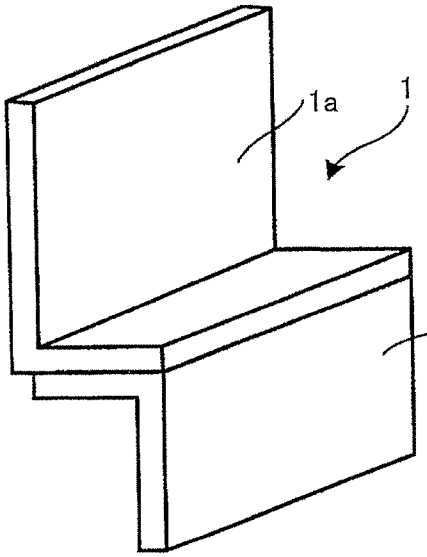
FIG. 15A to FIG. 15C are views of one example of a configuration of the heat-releasing member of FIG. 14A to FIG. 14C.
Figure 15B:
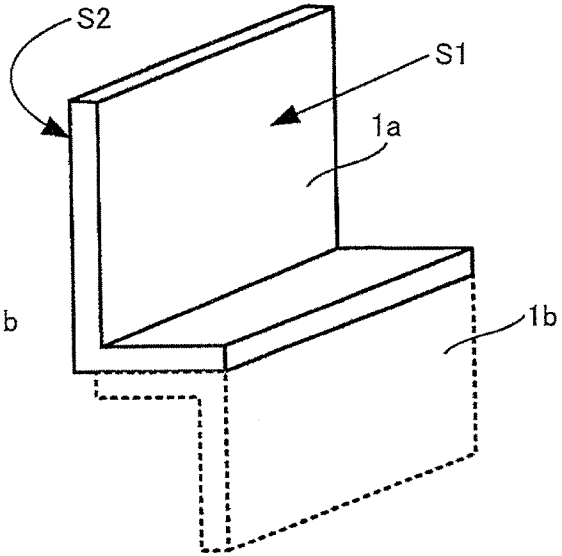
Figure 15C:
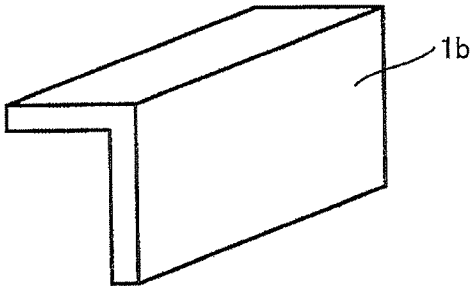

FIG. 15A to FIG. 15C are views of a configuration of the heat-releasing member 1 in the present embodiment.

In the present embodiment, the heat-releasing member 1 includes the first heat-releasing member 1*a* and the second heat-releasing member 1*b*. The first heat-releasing member 1*a* is arranged on the outside of the cover member 4 and includes the surface S2 exposed to the external air. The second heat-releasing member 1*b* arranged on the inside of the cover member 4 and includes one end portion for abutting the actuation controller 3. The first heat-releasing member 1*a* and the second heat-releasing member 1*b* are configured to contact each other. Two pairs of heat-releasing members 1 (1A and 1B) are thermally coupled to each other via the cover member 4. Each of the two pairs of heat-releasing members 1 includes the first heat-releasing member 1*a* and the second heat-releasing member 1*b* are configured to contact each other.

As illustrated in FIG. 15B, the surface S1 of the first heat-releasing member 1*a* is joined with the cover member 4 of the head body 7. The surface S2 is exposed to the external air.

As illustrated in FIG. 14C and FIG. 15A, the first heat-releasing member 1*a* and the second heat-releasing member 1*b* are configured to contact each other at abutting faces. The first heat-releasing member 1*a* abuts the external surface of the cover member 4. The second heat-releasing member 1*b* abuts an opening end portion of the cover member 4, at an end portion of the abutting face that abuts the first heat-releasing member 1*a*. Therefore, the two pairs of the heat-releasing members 1A and 1B are thermally coupled to each other via the cover member 4. Accordingly, in the present embodiment, in a similar manner to the fourth embodiment as described above, all of the actuation controllers 3 (i.e., four actuation controllers in the present embodiment) can have uniform temperatures.

<Liquid-Discharging Unit>

A liquid-discharging unit in one or more embodiments includes one of the above-described liquid-discharging heads.

Figure 17:
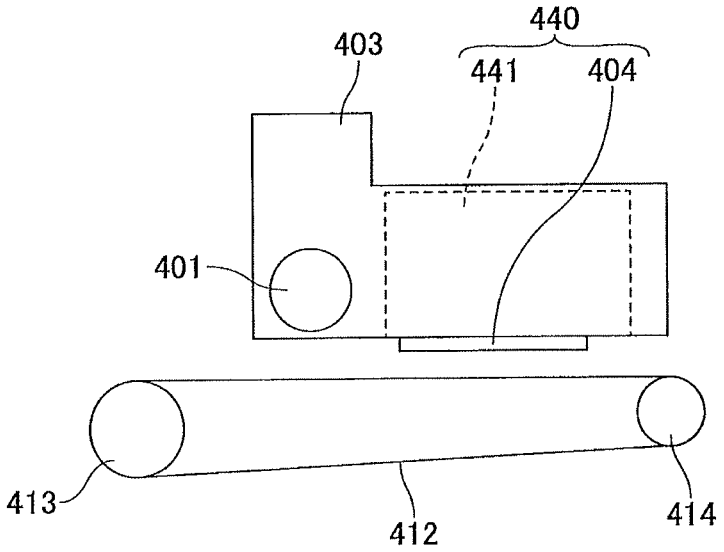
FIG. 17 is a side view of one example of a liquid-discharging unit.
Figure 18:
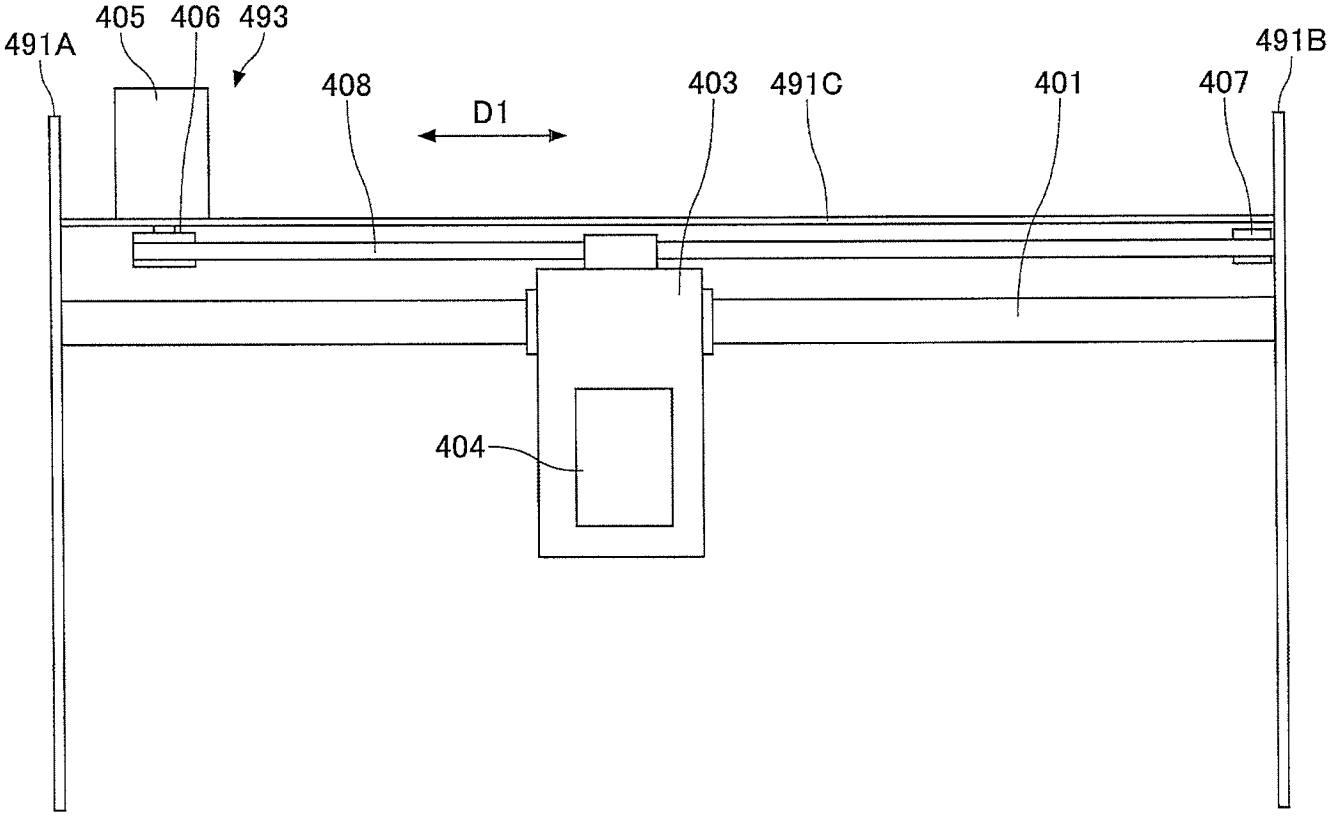
FIG. 18 is a top view of one example of the liquid-discharging unit.
Figure 19:
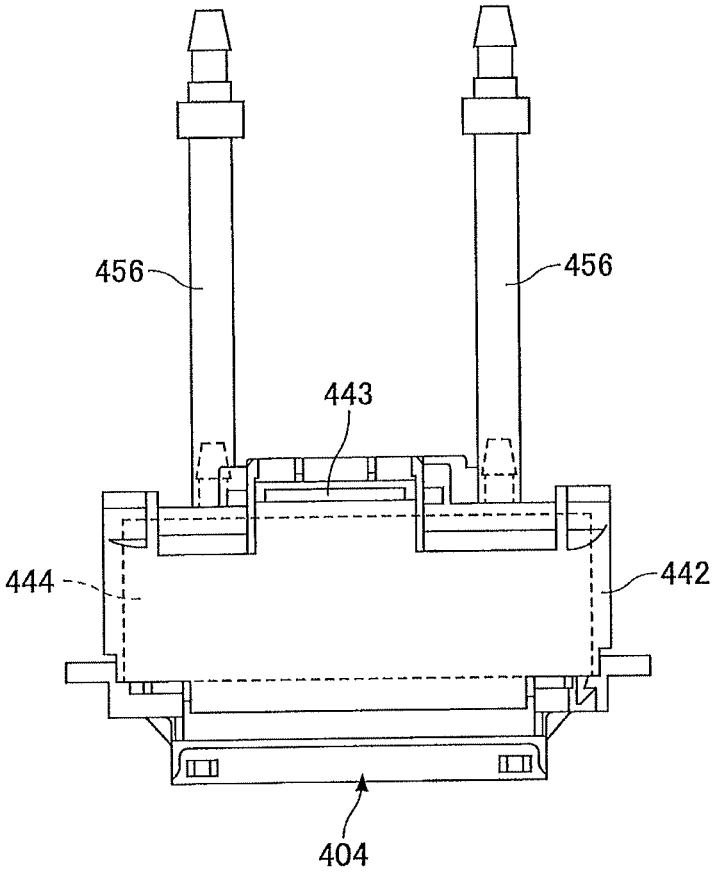
FIG. 19 is a side view of one example of the liquid-discharging unit.

FIG. 17, FIG. 18, and FIG. 19 illustrate one example of the liquid-discharging unit in one or more embodiments including one of the above-described liquid-discharging heads, whichever is carried as an inkjet head.

The "liquid-discharging unit" denotes an integrated configuration including the liquid-discharging head, to which other functional component parts and mechanisms are integrated. The "liquid-discharging unit" can be an assembly of component parts relating to liquid-discharging functionalities. Examples of the "liquid-discharging unit" may include any combinations of the liquid-discharging head and at least one of a head tank, a carriage, a supplying mechanism, a maintenance and recovery mechanism, and a main-scanning moving mechanism.

Herein, the integrated configuration may include the liquid-discharging head and other functional component parts and mechanisms that are secured to each other by, for example, fastening, bonding, or engaging. The integrated configuration may also include the liquid-discharging head and other functional component parts and mechanisms that are movably held by one of the liquid-discharging head and the functional component parts and mechanisms relative to the other. Additionally, the liquid-discharging head and other functional component parts and mechanisms may be detachable from one another.

As one example of a liquid-discharging unit 440, a liquid-discharging head 404 and a head tank 441 have an integrated configuration, as illustrated in FIG. 17. The liquid-discharging unit 440 illustrated in FIG. 17 is carried on a carriage 403. The carriage 403 is held by a guiding member 401 included in the main-scanning moving mechanism, and reciprocates in a main-scanning direction. FIG. 17 also illustrates a feed belt 412 configured to feed a recording medium (e.g., sheet of paper) and that is one of the component parts included in an apparatus configured to discharge liquid, as will be described later. The feed belt 412 may be an endless belt. The feed belt 412 is laid between a feed roller 413 and a tension roller 414.

As another example of the liquid-discharging unit 440, the liquid-discharging head 404 and the head tank 441 may be coupled to each other by tubes, for example, for an integrated configuration. A unit including a filter can be interposed between the head tank 441 and the liquid-discharging head 404, in the liquid-discharging unit 440.

Further, as another example of the liquid-discharging unit 440, the liquid-discharging head 404 and the carriage 403 may have an integrated configuration.

Further, as another example of the liquid-discharging unit 440, by holding the liquid-discharging head 404 for movement on the guiding member 401 that is included as part of a main-scanning moving mechanism 493, the liquid-discharging head 404 and the main-scanning moving mechanism 493 may have an integrated configuration. As illustrated in FIG. 18, as another example of the liquid-discharging unit 440, the liquid-discharging head 404, the carriage 403, and the main-scanning moving mechanism 493 may have an integrated configuration. The liquid-discharging unit 440 illustrated in FIG. 18 includes a housing including side plates 491A and 491B and a back plate 491C, the main-scanning moving mechanism 493, the carriage 403, and the liquid-discharging head 404, which are component parts included in the apparatus configured to discharge the liquid, as will be described later. An arrow D1 in FIG. 18 indicates the main-scanning direction.

Further, as another example of the liquid-discharging unit 440, by securing a cap member that is a part of the maintenance and recovery mechanism to the carriage 403 to which the liquid-discharging head 404 is attached, the liquid-discharging head 404, the carriage 403, and the maintenance and recovery mechanism may have an integrated configuration.

Further, as another example of the liquid-discharging unit 440, as illustrated in FIG. 19, by coupling tubes 456 to the liquid-discharging head 404 that is attached with a flow path part 444, the liquid-discharging head 404 and a supplying mechanism may have an integrated configuration. Through the tubes 456, the liquid in a liquid reservoir source is supplied to the liquid-discharging head 404.

The flow path part 444 is arranged in the inside of a cover 442. Instead of the flow path part 444, the head tank 441 can be included. A connector 443 configured to be electrically coupled to the flow path part 444 may be arranged on the top of the flow path part 444.

The main-scanning moving mechanism 493 may include only the guiding member 401. The supplying mechanism may include only the tubes or only a charging portion.

<Apparatus Configured to Discharge Liquid>

An apparatus configured to discharge liquid in one or more embodiments includes any one of the above-described liquid-discharging heads.

By including the liquid-discharging head that is capable of increasing the maximum discharging amount and that improves both the assembly performance and the heat-releasing efficiency, space saving is enabled. Downsizing and cost reduction of the apparatus configured to discharge liquid is also enabled. A malfunction caused by an increase in temperature is prevented and stable liquid discharging is enabled.

In one or more embodiments, examples of the "apparatus configured to discharge liquid" may include, but are not limited to, any apparatus including the liquid-discharging head or the liquid-discharging unit, so that the liquid is discharged by actuating the liquid-discharging head. Examples of the "apparatus configured to discharge liquid" may include not only any apparatus capable of discharging the liquid onto an object to which the liquid can be adhered but also any apparatus capable of discharging the liquid into the air or liquid.

Examples of the "apparatus configured to discharge liquid" may include not only any apparatus relating to feeding, conveying, or ejecting of an object to which the liquid can be adhered but also a pre-processing apparatus or a post-processing apparatus.

Examples of the "apparatus configured to discharge liquid" may include, but are not limited to, any image-forming apparatus configured to discharge ink to form an image on a sheet of paper and any stereoscopically shaping apparatus (i.e., three-dimensional shaping apparatus) configured to discharge a shaping liquid onto a powder layer made of powders formed in a layered shape to shape a stereoscopically shaped article (i.e., three-dimensional shaped article).

Examples of the "apparatus configured to discharge liquid" may include, but are not limited to, any apparatus configured to create an object in which significant images such as characters or drawings are visualized with the discharged liquid. Examples of the "apparatus configured to discharge liquid" may also include any apparatus configured to create a pattern of no specific meaning and any apparatus for shaping a three-dimensional figure.

Examples of the above-described "object to which the liquid can be adhered" may include, but are not limited to, any object to which the liquid can be adhered at least temporarily, any object to which the liquid is adhered and then firmly adhered, and any object to which the liquid is adhered and then permeated. Specific examples of the "object to which the liquid can be adhered" may include, but are not limited to, any recording medium such as a sheet of paper, recording sheet of paper, film, and cloth, an electronic part such as an electronic substrate and a piezoelectric element, and any medium such as a powder layer, an internal organ model, and a cell for testing. Examples of the "object to which the liquid can be adhered" may include, but are not particularly limited to, any object to which the liquid can be adhered.

Examples of materials of the above-described "object to which the liquid can be adhered" may include, but are not limited to, any material to which the liquid can be adhered temporarily, such as a sheet of paper, string, fiber, cloth, leather, metal, plastic, glass, timber, and ceramics.

Additionally, examples of the "liquid" may include, but are not particularly limited to, any type of liquid having a viscosity or surface tension with which the liquid is dischargeable from the liquid-discharging head. The liquid may have a viscosity equal to or lower than 30 mPa·s, at normal temperature and normal pressures or when the liquid is heated or cooled. More specifically, the liquid may include, but are not limited to, for example, at least a solvent such as water or an organic solvent, a coloring agent such as a dye or pigment, a liquid solution, a suspending solution, and an emulsion. The liquid solution, the suspending solution, or the emulsion may contain at least one of a function-providing material such as a polymerizable compound, a resin, or a surface-active agent, a biomaterial such as DNA, amino acid, protein, or calcium, and an edible material such as a natural coloring matter. These examples of the liquid can be used for, for example, ink used for inkjet, surface treatment liquid, liquid used for forming component elements such as electronic elements or light-emitting elements or resist patterns of electronic circuits, and material liquid used for three-dimensional shaping.

Examples of the "apparatus configured to discharge liquid" may include, but are not limited to, any apparatus in which the liquid-discharging head and the object to which the liquid can be adhered move relatively to each other. Specific examples of the "apparatus configured to discharge liquid" may include any serial apparatus in which the liquid-discharging head moves and any line apparatus in which the liquid-discharging head does not move.

In addition, examples of the "apparatus configured to discharge liquid" may include any treatment liquid coating apparatus configured to discharge treatment liquid onto a sheet of paper to coat the sheet surface with the treatment liquid for the purpose of reforming the sheet surface, and any injection granulation apparatus configured to inject composition liquid in which raw materials are dispersed in a liquid solution through nozzles to granulate fine particles of the raw materials.

Figure 16A:
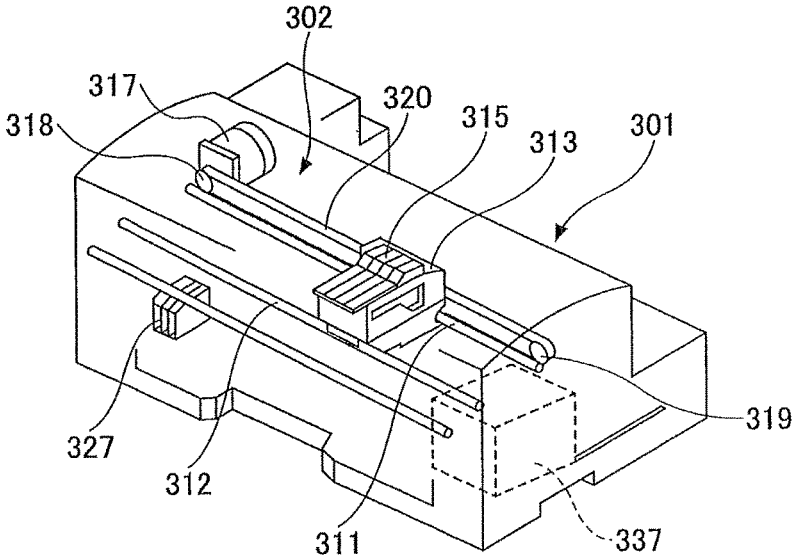
FIG. 16A is a perspective view of an outline of substantial parts in an apparatus configured to discharge liquid.
Figure 16B:
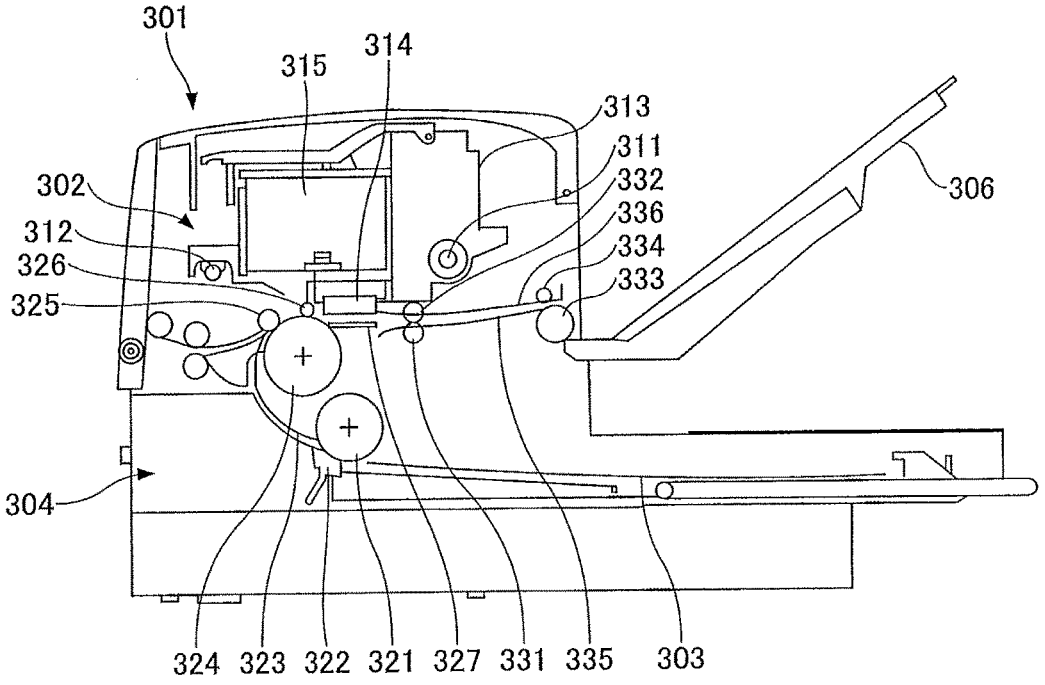
FIG. 16B is a side view of the outline of substantial parts in the apparatus configured to discharge the liquid.

FIG. 16A and FIG. 16B illustrate examples of an inkjet image-forming apparatus, on which the liquid-discharging head in one or more embodiments is mounted as an inkjet head and which is an apparatus configured to discharge liquid. FIG. 16A is a perspective view of an outline of substantial parts in the inkjet image-forming apparatus. FIG. 16B is a side view of the outline of substantial parts in the inkjet image-forming apparatus.

In such an inkjet image-forming apparatus 301, the liquid-discharging unit is accommodated in a printing mechanism portion 302 in the inside of the body of the inkjet image-forming apparatus 301. The liquid-discharging unit includes a carriage movable in the main-scanning direction, a recording head included in an inkjet head carried on the carriage, and an ink cartridge that supplies the recording head with ink. At the lower portion of the body of the inkjet image-forming apparatus 301, a paper-supplying cassette (i.e., paper feed tray) 304, on which a plurality of sheets of recording paper 303 can be placed, can be attached from the front side of the inkjet image-forming apparatus 301 in a removable manner. A manual feed tray 305 for manually feeding the sheet of recording paper 303 can be opened and tilted. The sheet of recording paper 303 fed from the paper-supplying cassette 304 or the manual feed tray 305 is taken into the inkjet image-forming apparatus 301. After the printing mechanism portion 302 records a desired image, the sheet of recording paper 303 is ejected onto a paper-receiving tray 306 that is attached on the back side of the inkjet image-forming apparatus 301.

In the printing mechanism portion 302, the main-guide rod 311 and the sub-guide rod 312, which are guide members that are laterally laid on left and right side plates, not illustrated, hold the carriage 313 slidably in the main-scanning direction. Recording heads 314 including the inkjet heads that discharge ink droplets of colors including Yellow (Y), Cyan (C), Magenta (M), and Black (B) are carried on the carriage 313, such that a plurality of ink-discharging holes are arrayed in a direction crossing the main-scanning direction to discharge the ink droplets downward. Ink cartridges 315, which supply the recording heads 314 with the ink of the respective colors, are placed in the carriage 313 in a replaceable manner.

The ink cartridge 315 includes an atmosphere port communicating with the atmosphere at an upper portion, a supply port that supplies the inkjet head with ink, and a porous body in which the ink is filled in the inside of the ink cartridge 315. Capillary force of the porous body maintains the ink to be supplied to the inkjet head at a slightly negative pressure.

Herein, the recording heads 314 for the respective colors are used as the recording head. However, a single recording head including nozzles that discharge ink droplets of the respective colors may be applicable. Further, the inkjet head used as the recording head 314 can be any piezoelectric inkjet head configured to apply pressure on the ink via a vibrating plate included in a liquid chamber wall face with an electromechanical converting element such as a piezoelectric element, any bubble inkjet head configured to apply pressure on the ink by generating bubbles with a heating resistor element, or any electrostatic inkjet head configured to apply pressure on the ink by displacing the vibrating plate with an electrostatic force between the vibrating plate included in an ink flow path wall surface and a counter electrode. In one or more embodiments, however, the electrostatic inkjet head may be used.

The carriage 313 is slidably fit with the main-guide rod 311 on the back side (i.e., downstream side in the sheet-feeding direction), and is slidably mounted on the sub-guide rod 312 on the front side (i.e., upstream side in the sheet-feeding direction). In order for the carriage 313 to move and scan in the main-scanning direction, a timing belt 320 is stretched between a driving pulley 318 to be driven for rotation by a main-scanning motor 317 and a driven pulley 319. The timing belt 320 is secured to the carriage 313. Forward and reverse rotation of the main-scanning motor 317 reciprocates the carriage 313.

To feed the sheet of recording paper 303 that has been set on the paper-supplying cassette 304 to the lower side of the recording heads 314, the inkjet image-forming apparatus 301 includes a paper-feeding roller 321 and a friction pad 322 configured to isolate the sheet of recording paper 303 from the paper-supplying cassette 304 to feed the sheet of recording paper 303, a guiding member 323 configured to guide the sheet of recording paper 303, a feeding roller 324 configured to reverse the sheet of recording paper 303 that has been fed, and to feed the reversed sheet of recording paper 303, a transporting roller 325 that is pressed against a circumferential surface of the feeding roller 324, and an end roller 326 configured to define a fed-out angle of the sheet of recording paper 303 from the feeding roller 324. The feeding roller 324 is driven for rotation by a sub-scanning motor 327 through a gear train.

The inkjet image-forming apparatus 301 further includes a print-receiving member 329 serving as a sheet guiding member arranged below the recording heads 314 and configured to guide the sheet of recording paper 303 that has been fed from the feeding roller 324, in accordance with a moving range in the main-scanning direction of the carriage 313. The inkjet image-forming apparatus 301 further includes a transfer roller 331 configured to be driven for rotation to feed the sheet of recording paper 303 in a sheet-ejecting direction, and a spur 332, which are arranged on the downstream side relative to the print-receiving member 329 in the sheet-feeding direction. The inkjet image-forming apparatus 301 further includes a sheet-ejecting roller 333 and a spur 334 configured to feed the sheet of recording paper 303 onto the paper-receiving tray 306, and guiding members 335 and 336 included in a sheet-ejecting path.

At time of recording, by actuating the recording heads 314 in response to image signals while moving the carriage 313, the ink is discharged onto the sheet of recording paper 303 that is stationary for recording one line. After the sheet of recording paper 303 is fed by a given amount, the ink is discharged to record the next line. On receiving a recording end signal or a signal indicating that the last edge of the sheet of recording paper 303 has reached a recording area, a recording operation is ended and the sheet of recording paper 303 is ejected.

The inkjet image-forming apparatus 301 further includes a recovery device 337 configured to recover a discharge failure of the recording heads 314 at a location outside the recording area on the right end relative to the moving direction of the carriage 313. The recovery device 337 includes a capping unit, a suction unit, and a cleaning unit. During the print standby period, the carriage 313 is located on the recovery device 337 side. With the capping unit capping the recording heads 314, keeping the ink-discharging holes in wet states prevents a discharge failure caused by drying of the ink. In addition, by discharging the ink that is not related to the recording while the recording is being performed, ink viscosities at all the ink-discharging holes are made constant. Hence, stable discharging capabilities are maintained.

In the case of a discharge failure occurring, the capping unit seals the ink-discharging holes of the recording heads 314, the suction unit sucks out bubbles together with the ink from the ink-discharging holes via tubes, and the cleaning unit removes ink and contamination adhered to a face where the ink-discharging holes are provided. In this manner, recovery from the discharge failure is achieved. The sucked ink is ejected to a waste ink reservoir, not illustrated, installed on the lower portion of the body of the inkjet image-forming apparatus 301. Such waste ink is absorbed and held by an ink absorber in the waste ink reservoir.

Further, the present invention is not limited to these embodiments, but various variations and modifications may be made without departing from the scope of the present invention.

What is claimed is:

1. A liquid-discharging head comprising:

a pressure-generating element configured to be actuated to apply pressure on liquid in a pressure chamber from which the liquid is discharged through a nozzle;

an actuation controller configured to control actuation of the pressure-generating element;

a heat-releasing member configured to contact the actuation controller; and a cover member configured to cover the actuation controller and part of the heat-releasing member, the heat-releasing member including a first heat-releasing member arranged outside the cover member and having a surface exposed to external air, and a second heat-releasing member arranged inside the cover member and having a first end portion to contact the actuation controller, wherein at least a portion of the second heat-releasing member arranged inside the cover member faces an inner side of the cover member, and at least a portion of the first heat-releasing member arranged outside the cover member faces an outer side of the cover member, opposite to said inner side of the cover member, and wherein the first heat-releasing member and the second heat-releasing member are arranged to contact each other.

2. The liquid-discharging head according to claim 1, further comprising a wiring member configured to transfer a signal to the actuation controller, the wiring member being attachable to a head body including the heat-releasing member.

3. The liquid-discharging head according to claim 1, wherein at least one of the first heat-releasing member and the second heat-releasing member includes an engaging portion having a letter L shape, and the first heat-releasing member and the second heat-releasing member are arranged to contact each other via the engaging portion.

4. The liquid-discharging head according to claim 1, wherein the first heat-releasing member is arranged to cover a side surface in a longer direction of the cover member.

5. The liquid-discharging head according to claim 1, wherein the cover member includes a bending portion capable of contacting a second end portion of the second heat-releasing member, and the second end portion of the second heat-releasing member is sandwiched between the bending portion and the first heat-releasing member.

6. The liquid-discharging head according to claim 1, wherein the first heat-releasing member and the second heat-releasing member makes a first pair, wherein the liquid-discharging head further comprises another first heat-releasing member and another second heat-releasing member configured to contact each other and to make a second pair, and wherein the first pair and the second pair are arranged to be thermally coupled to each other.

7. The liquid-discharging head according to claim 6, wherein the first pair and the second pair are arranged to contact each other.

8. A liquid-discharging unit comprising a plurality of the liquid-discharging heads of claim 1.

9. An apparatus configured to discharge liquid, the apparatus comprising the liquid-discharging head of claim 1.

10. A liquid-discharging head comprising:

a pressure-generating element configured to be actuated to apply pressure on liquid in a pressure chamber from which the liquid is discharged through a nozzle;

an actuation controller configured to control actuation of the pressure-generating element;

a heat-releasing member configured to contact the actuation controller; and a cover member configured to cover the actuation controller and part of the heat-releasing member, the heat-releasing member including a first heat-releasing member arranged outside the cover member and having a surface exposed to external air, and a second heat-releasing member arranged inside the cover member and having a first end portion to contact the actuation controller, wherein at least a portion of the first heat-releasing member arranged outside the cover member contacts an outer surface of the cover member, and wherein the first heat-releasing member and the second heat-releasing member are arranged to contact each other.

11. A liquid-discharging unit comprising a plurality of the liquid-discharging heads of claim 10.

12. An apparatus configured to discharge liquid, the apparatus comprising the liquid-discharging head of claim 10.

13. The liquid-discharging head according to claim 10, wherein the first heat-releasing member and the second heat-releasing member makes a first pair, wherein the liquid-discharging head further comprises another first heat-releasing member and another second heat-releasing member configured to contact each other and to make a second pair, and wherein the first pair and the second pair are arranged to be thermally coupled to each other.

14. The liquid-discharging head according to claim 13, wherein the first pair and the second pair are arranged to contact each other.

* * * * *